US006401948B1

(12) United States Patent
Huang

(10) Patent No.: US 6,401,948 B1
(45) Date of Patent: Jun. 11, 2002

(54) HANGER FOR DISPLAYING CLOTHING

(76) Inventor: Chi-Tzung Huang, No. 50-5, Ta Chueh Wei, Ta Chueh Village, Shui Shang Hsiang, Chia Yi Hsien (TW)

( * ) Notice: Subject to any disclaimer, the term of this patent is extended or adjusted under 35 U.S.C. 154(b) by 0 days.

(21) Appl. No.: 09/742,234

(22) Filed: Dec. 22, 2000

(51) Int. Cl.[7] ..... A47B 47/00
(52) U.S. Cl. ..... 211/206
(58) Field of Search ..... 211/206, 204, 211/182, 189, 123, 207, 195, 175, 105.5, 105.6; 248/165; 280/79.3; 403/322.3, 109.3, 109.7

(56) References Cited

U.S. PATENT DOCUMENTS

| | | | | | |
|---|---|---|---|---|---|
| 1,015,448 | A | * | 1/1912 | Madden | 211/206 |
| 1,830,282 | A | * | 11/1931 | Lorch | 211/206 |
| 2,516,364 | A | * | 7/1950 | Caddell | 211/206 |
| 2,533,324 | A | * | 12/1950 | Mendle | 211/206 |
| 2,793,764 | A | * | 5/1957 | Stork | 211/206 |
| 3,144,946 | A | * | 8/1964 | Ellis | 211/206 |
| 3,146,892 | A | * | 9/1964 | White | 211/206 |
| 3,499,541 | A | * | 3/1970 | Mackie | 211/206 |
| 3,503,525 | A | * | 3/1970 | Loebner | 211/206 |
| 3,620,377 | A | * | 11/1971 | Holtz | 211/182 |
| 3,705,731 | A | * | 12/1972 | Berchak | 280/79.3 |
| 3,918,591 | A | * | 11/1975 | Cooper | 280/79.3 |
| 4,164,288 | A | * | 8/1979 | Okazaki | 211/207 |
| 5,186,341 | A | * | 2/1993 | Zeid | 211/204 |
| 5,617,962 | A | * | 4/1997 | Chen | 211/206 |
| 5,660,637 | A | * | 8/1997 | Dodge | 280/79.3 |
| 5,718,344 | A | * | 2/1998 | Joldeson et al. | 211/206 |
| 6,224,072 | B1 | * | 5/2001 | Weck et al. | 280/79.3 |

* cited by examiner

*Primary Examiner*—Daniel P. Stodola
*Assistant Examiner*—Jennifer E. Novosad
(74) *Attorney, Agent, or Firm*—Rosenberg, Klein & Lee

(57) ABSTRACT

A hanger apparatus for displaying clothing includes two lateral rods, a connecting bar, two side support tubes, and a hang bar. The side support tubes together with the sleeves of the connecting bar are tightly screwed with the lateral rods, and the combination of the hang bar and the inner tubes in the side support tubes is effected by mutual engagement of an insert button and corresponding insert hole. The resulting assembly may be disassembled for packing or storing. A U-shaped plate is disposed under the side support tube to form a gap having sufficient height for the friction wheels to expand outward and bear against the bottom side of the inner tube so as to stabilize the whole structure, when the inner tube is pressed downward.

3 Claims, 6 Drawing Sheets

HANGER FOR DISPLAYING CLOTHING

BACKGROUND OF THE INVENTION

This invention relates to a hanger for displaying clothing, particularly to one possible to economize packing space and lower transporting cost, and convenient for transporting a whole hanger without need of disconnection.

A conventional hanger for displaying clothing, as shown in FIG. 6, consists of a bottom base so, two side support tubes 51 and a hang bar 52 as main components combined together.

The bottom base 50 has two lateral rods 501 provided with casters 502 and a sleeve 503 with a screw hole 504 in one side, and a connecting bar 505 connecting two sleeves 503.

Further, each side support tube 51 is fitted in the sleeve 503 of the bottom base 50, and the hang bar 52 has a vertical inner tube 520 fixed at each end to be fitted respective in a side support tube 51 to be able to move up and down for adjustment of the height, as shown in FIGS. 7 to 10.

The inner tube 521 is provided orderly from top to bottom with a press button 522, a stop member 523, a coiled-spring 524 and friction wheels 526, all of them connected with a connecting bar 525 provided integral at the lower end with; a support member 528 having an arc-shaped top recess 527.

In assembling, two side support tubes 51 are respectively fitted In each sleeve 503 of the bottom base 50, letting them push against each other by means of a screw 511 screwing in the screw hole 504 in one side of the sleeve 503. Then, two inner tubes 521 of the hang bar 52 are respectively fitted into the side support tube 51 to finish the assembly.

The height of the hang bar 52 can be adjusted by pressing down the press button 522 on the top of the inner tube 520 to let the friction wheels 526 slide down and separate from the support member 528 for facilitating adjustment of the height of the hanger, and when it reaches a needed height, release the press button 522 to let the friction wheels 526 move up by the resilience of the coiled spring 524 to touch the support member 528, and forced to expand to rest tightly at a proper position in the side support tube 51 so as to fix the hang bar 52 at a certain location.

Evidently, the conventional hanger for displaying clothing mentioned above has the functions of stability and adjustment of the height, but it is still found some defects as follows.

1. The bottom base is made up of a connecting bar and two lateral rods, and the hang bar is fixed with two vertical inner tubes, not convenient for packing, storing or transporting.

2. A screw screwing in the screw hole of the sleeve to push against the side support tube, impossible to be tightly fixed, carries out the combination of the side support tube with the bottom base. Besides, excessively tight screwing may damage the side support tube, reducing its service life.

3. The hang bar is kept positioned only by the friction wheel pushing against the bottom side of the inner tube so that a snap motion of pulling up the hang bar may cause the heavy bottom base fall off, resulting in unnecessary trouble.

SUMMARY OF THE INVENTION

The objective of this invention is to offer a hanger for displaying clothing, including two inner tubes respectively fitted in each side support tube, and provided on the top with a vertical sleeve for receiving a hang bar. Then, a connecting bar has a sleeve at each end for a screw under each side support tube to screw through, and at the same time to be fixed with the lateral rod. Such structure is easy to be disassembled for convenience of packing or storing.

The feature of this invention is two side support tubes each having a U-shaped plate with a bolt at bottom center to be fixed with the lateral rod, forming a space between the side support tube and the lateral rod. When the hang bar is pressed downward, the inner tube will also move down to let the friction wheels completely positioned under the side support tube to make the inner tube fixed in place not easy to be pulled out.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
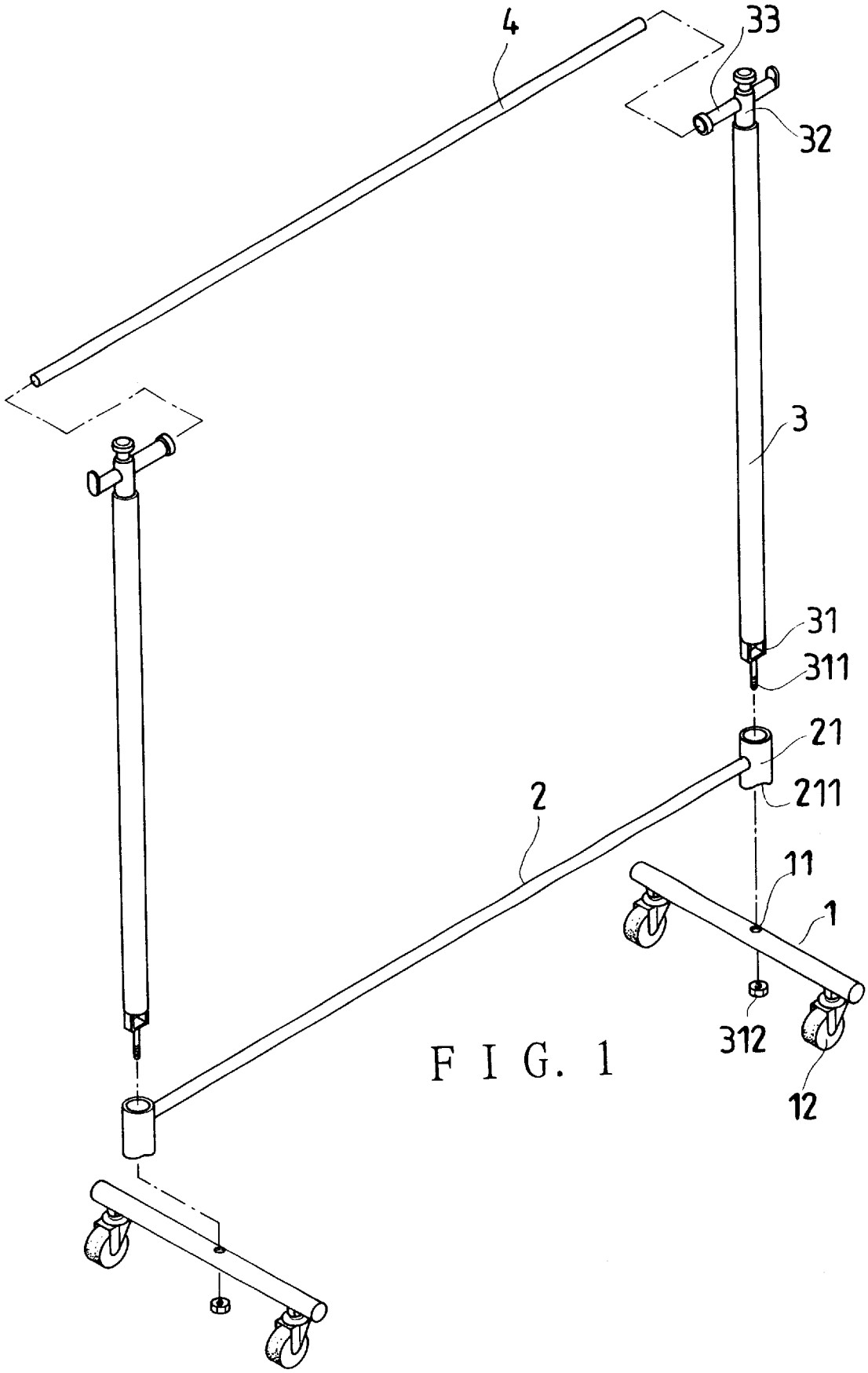
FIG. 1 is an exploded perspective view of a hanger for displaying clothing of the present invention.

A preferred embodiment of a hanger for displaying clothing in the present invention, as shown in FIG. 1, includes two lateral rods 1, a connecting bar 2, two side support tubes 3, and a hang bar 4 as main components combined together.

Figure 2:
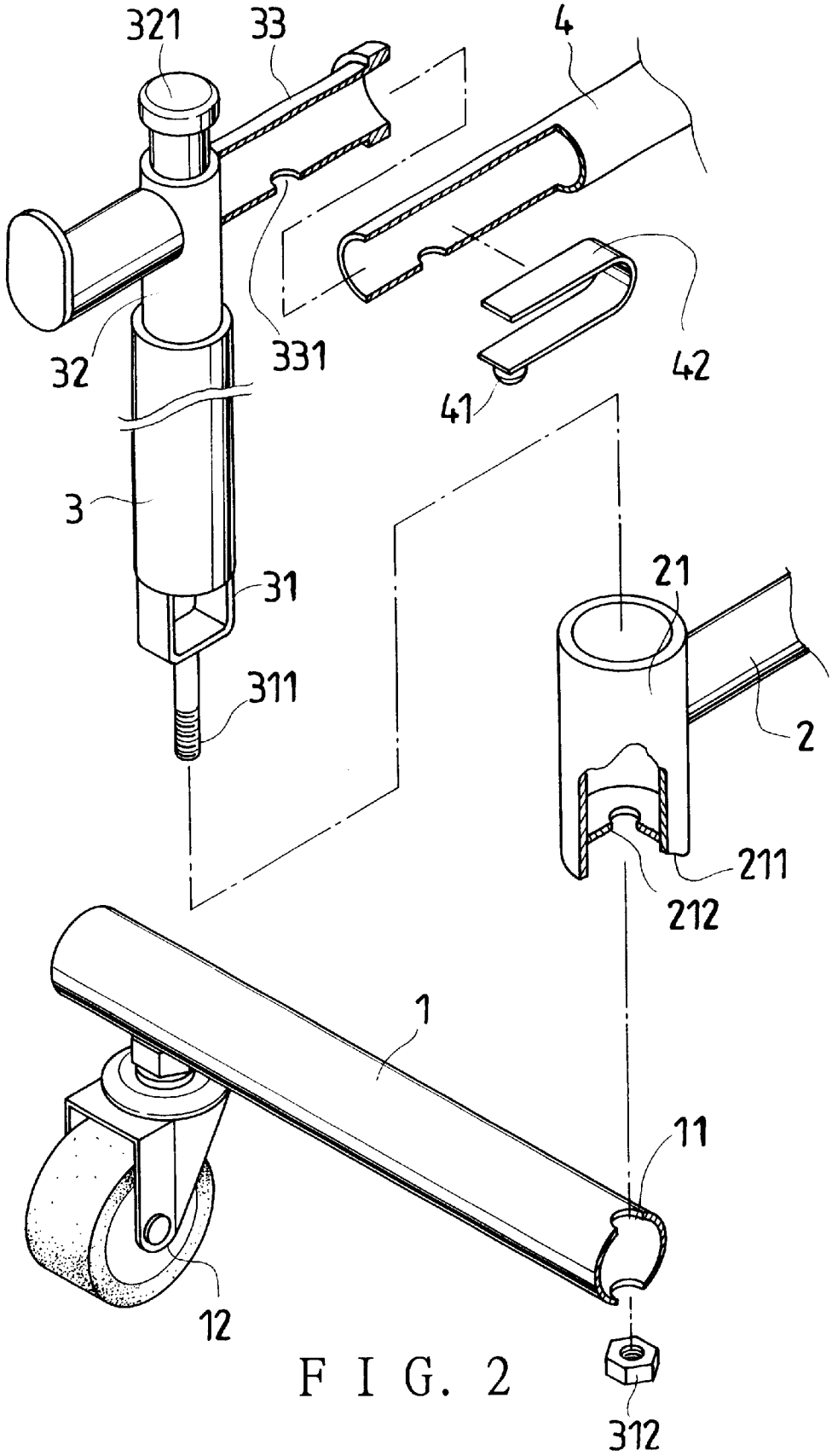
FIG. 2 is an enlarged exploded perspective view of the hanger for displaying clothing of the present invention.

The two lateral bars 1, as shown in FIG. 2, respectively have a vertical hole 11 in the center and casters 12 fixed at two sides of the bottom.

The connecting bar 2 has a sleeve 21 each at two ends, and each sleeve 21 has an arc-shaped recess 211 in its bottom and having a ring member 212 welded integral inside.

Figure 3:
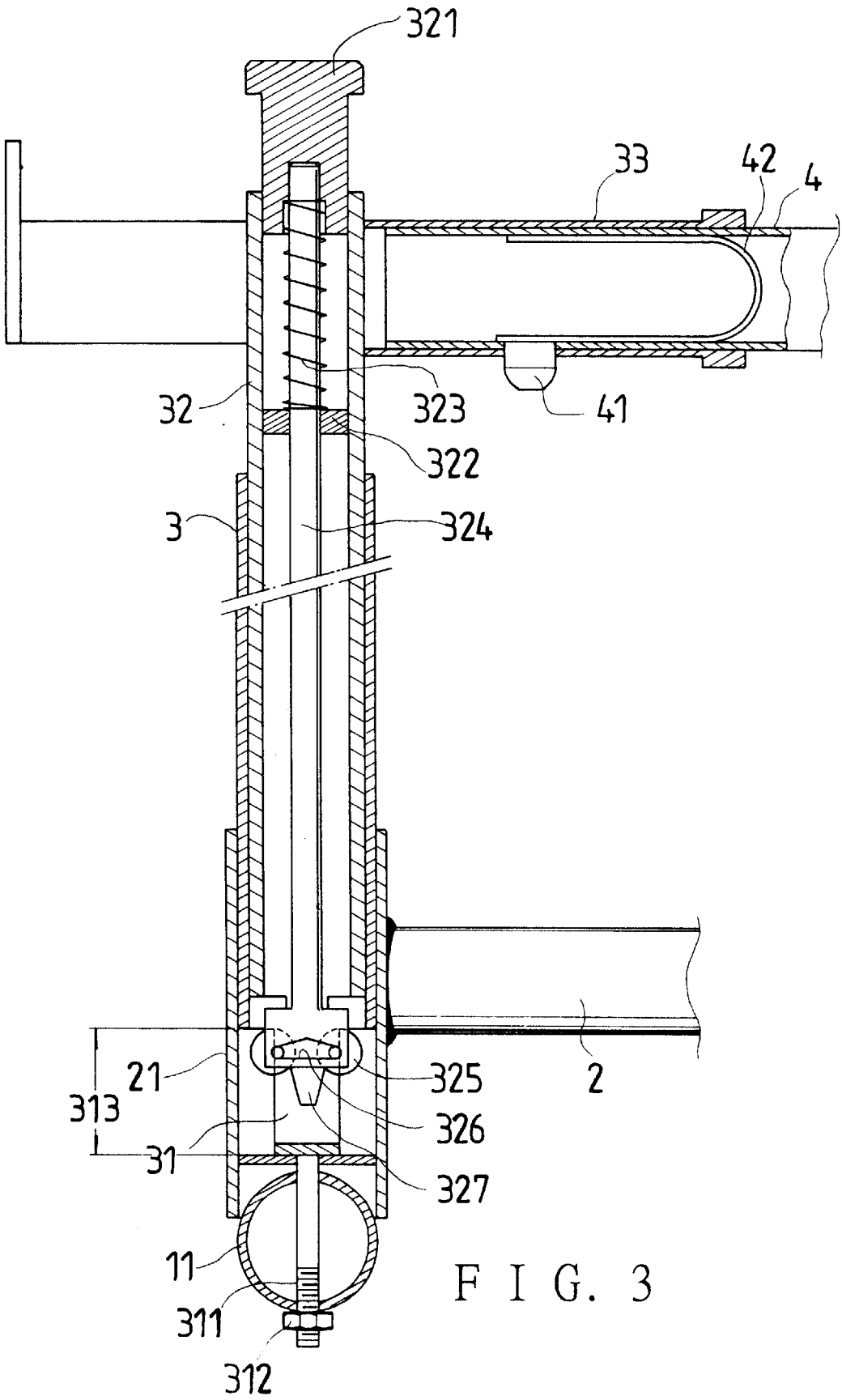
FIG. 3 is a side cross-sectional view of a hanger for displaying of the present invention.

The two side support tubes 3, as shown in FIG. 3, are respectively provided with a U-shaped plate 31 at a lower end having a vertical bolt 311 at a bottom center. An inner tube 32 is fitted in each side support tube 3, having a connecting sleeve 33 fixed on an upper portion and an inserting hole 331 in a lower side. Then, each inner tube 32 is provided with, in positional sequence, a press button 321, a coil member 323, a stop member 322, and friction wheels 325 at the lower end, all connected with a connecting bar

324. Each inner tube 32 is fixed at the lower end with a support plate, or member, 327 having an upward arc-shaped recess 326.

Then, each end of the hang bar 4 is provided with a U-shaped elastic member 42 fixed with an inserting button 41 protruding out normally.

Figure 5:
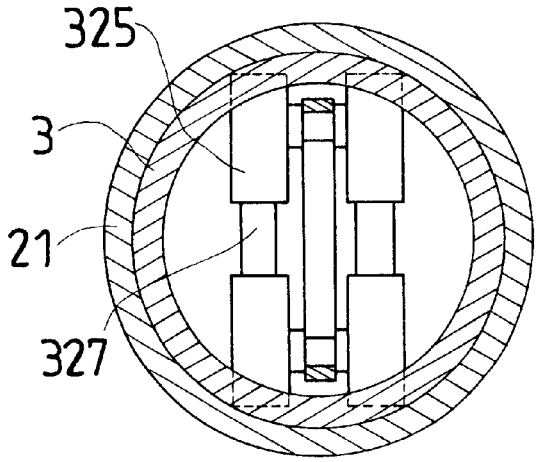
FIG. 5 is an upper view of the inner tube of the hanger for displaying clothing of the present invention.
Figure 4:
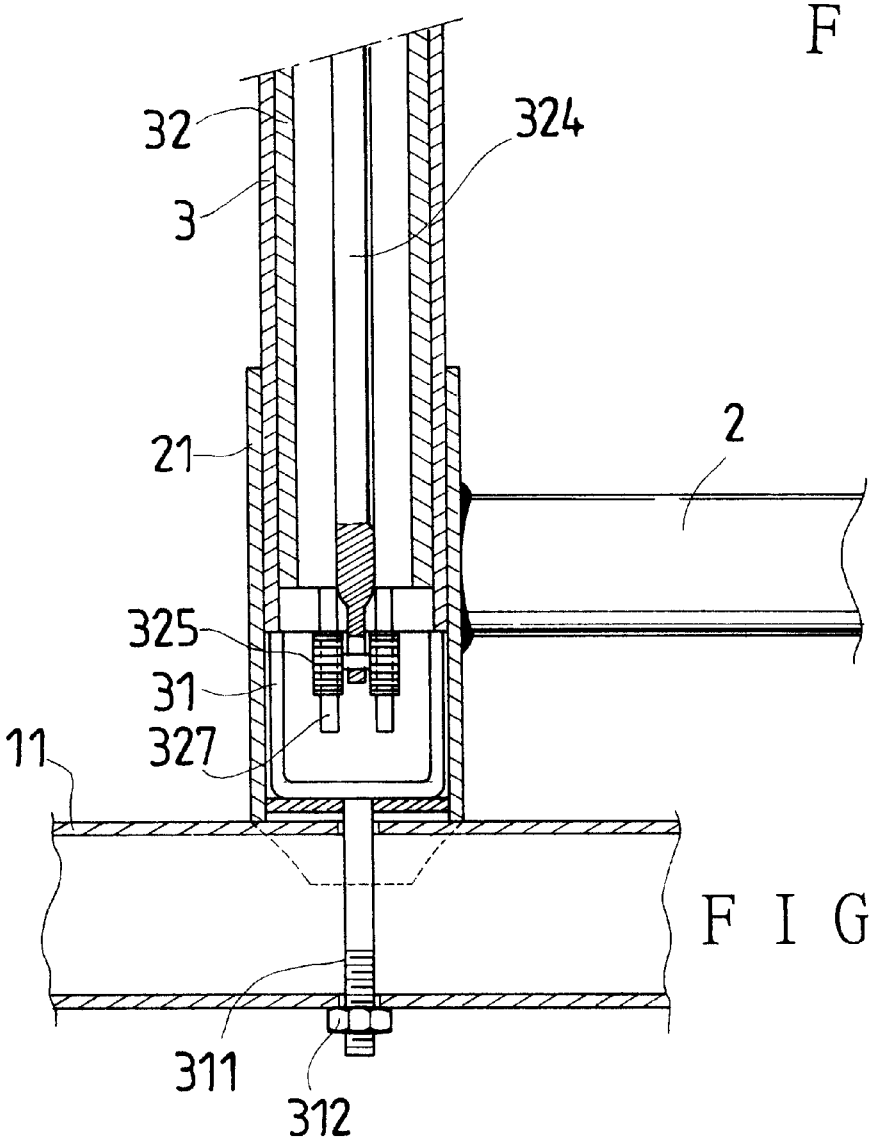
FIG. 4 is a partial cross-sectional view of the hanger for displaying clothing of the rent invention.
Figure 6:
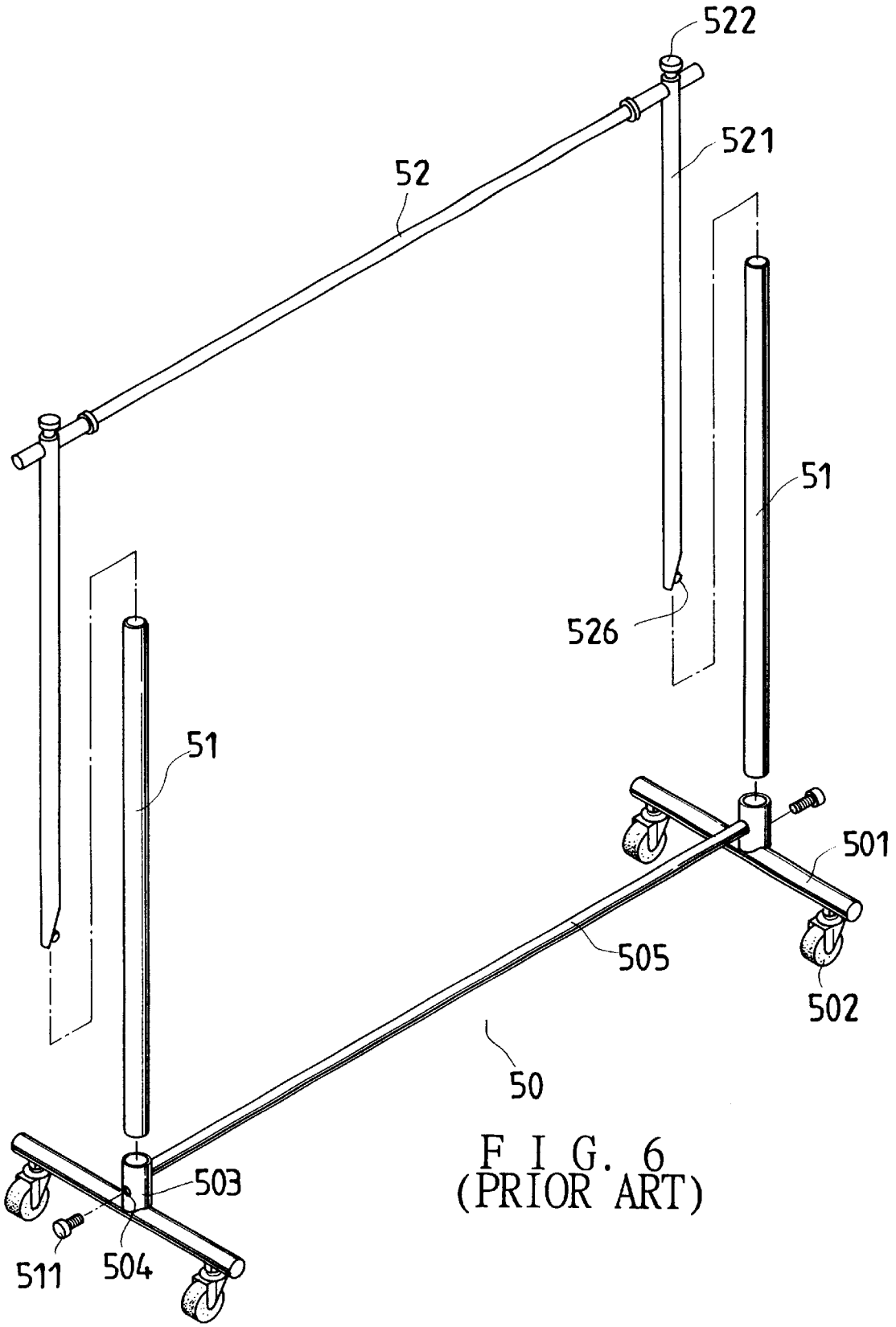
F I G. 6 (PRIOR ART)
FIG. 6 is an exploded perspective view of a conventional hanger for displaying clothing.
Figure 7:
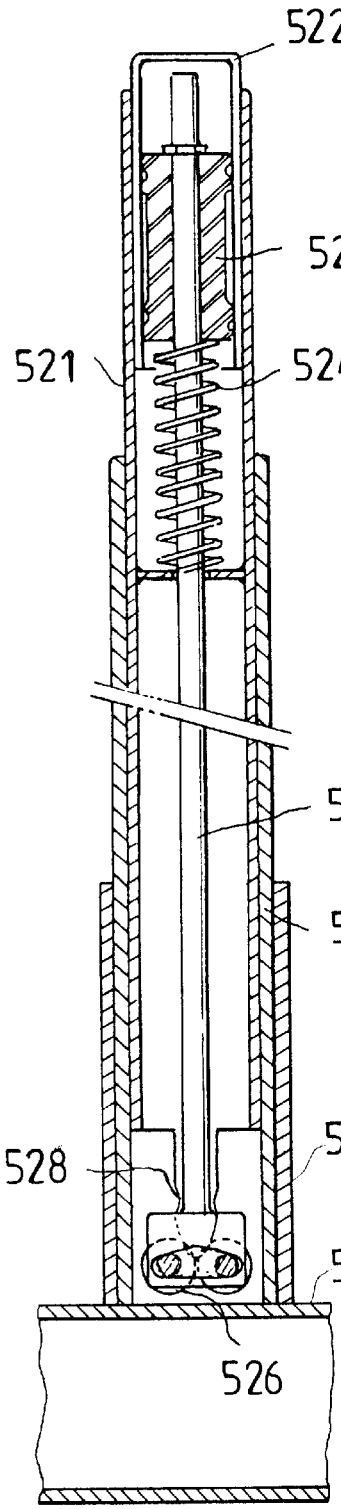
FIG. 7 (PRIOR ART)
FIG. 7 is a cross-sectional view of the inner tube of the conventional hanger for displaying clothing, showing the friction wheels not touching with the inner tube.
Figure 9:
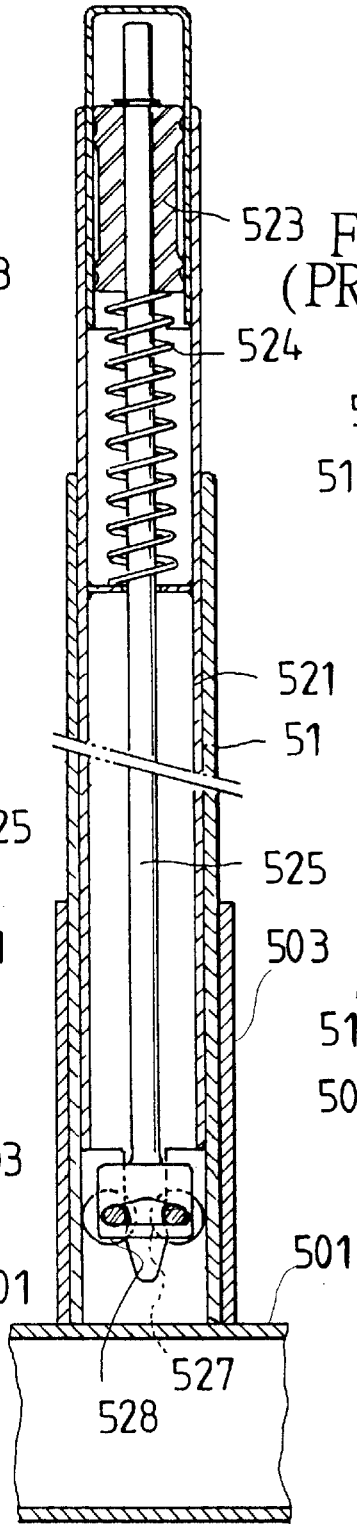
FIG. 9 (PRIOR ART)
FIG. 9 is a cross-sectional view of the inner tube of the conventional hanger for displaying clothing, showing the friction wheels pushing against the bottom of the inner tube.
Figure 8:
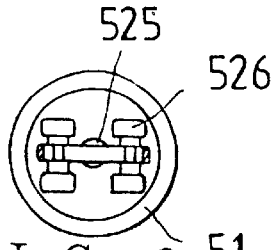
FIG. 8 (PRIOR ART)
FIG. 8 is an upper view of the inner tube of the conventional hanger for displaying clothing, showing the friction wheels not touching with the inner tube.
Figure 11:
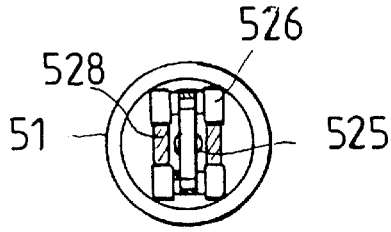
FIG. 11 (PRIOR ART)
FIG. 11 is an upper view of the inner tube of the conventional hanger.
Figure 10:
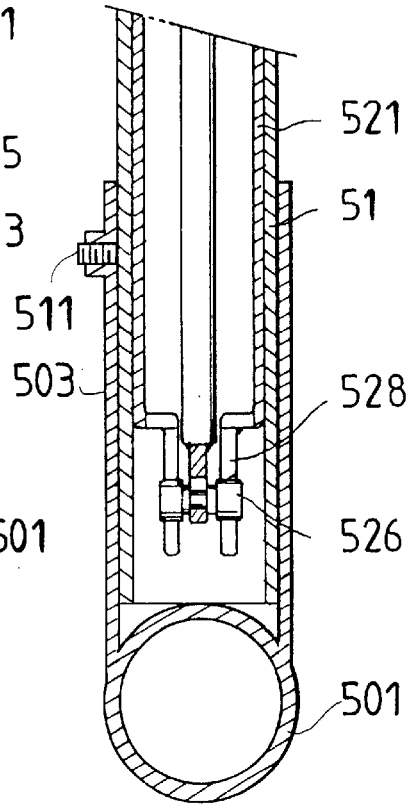
FIG. 10 (PRIOR ART)
FIG. 10 is a side-sectional view of the inner tube of the conventional hanger for displaying clothing.

In assembling, as shown in FIGS. 3 to 5, firstly, two sleeves 21 of the connecting bar 2 are exactly positioned on the central holes 11 of the two lateral rods 1, making the arc-shaped recess 211 of the sleeve 21 closely fit the lateral rod 1, letting the inserting hole 11 of the lateral rod 1 exactly face the central opening of the ring 212 in the sleeve 21. Then, the side support tube 3 is inserted in the sleeve 21 with the screw 311 under the U-shaped plate 31 of the side support tube 3. A gap 313 is provided between the lateral rods 1 and the U-shaped plate 31. Then, the screw 311 of the U-shaped plate 31 is screwed through both the ring 212 inside the sleeve 21 and the inserting hole 11 of the lateral rod 1 to combine the side support tube 3 with the two sleeves 21 at two ends of the connecting bar 2 and at the same time fixed on the lateral rod 2 fixedly by means of a nut 312.

Then, insert both ends of the hang bar 4 respectively in the inserting sleeves 33 at the upper portion of the inner tubes 32 to let the inserting button 41 insert in the inserting hole 331 of the connecting sleeve 33 by elasticity of the elastic member 42, thus finishing the assembly.

In using, when the hang bar 4 is pressed downward, the inner tubes 32 will also move down, pushing the friction wheels 325 to slip down and rest under the bottom of the side support tubes 3 and then expand outward by the upward resilient force of the spring 323 to push against the bottom portion of the side support tubes 3, preventing the hang bar 4 from pulled out.

As can be understood from the above description, this invention has the following advantages.

1. The connection of the hang bar with the inner tubes is effected by mutual engagement of the inserting buttons of the hand bar and the inserting holes of the connecting sleeves, and besides, the combination of the side support tubes, the connecting bar and the lateral rods is effected by screwing them together at the same time, so that it is easy to disconnect them for packing with less space, and possible to reduce transporting cost.

2. The combination of the side support tube, the sleeve of the connecting bar and the lateral bar is carried out by the bolt under the U-shaped plate screwing through the sleeve and the inserting hole of the lateral bar and fixed by mean's of a nut, thus achieving an effect of stability.

3. When the hang bar is pressed downward, the inner tube will at the same time be pushed to drive the friction wheels to rest under the side support tube and then expand outward to push against the bottom side of the inner tube so that the hang bar and the inner tube cannot be pulled out, and the lateral rods are not liable to fall off, either, in case the whole hanger is pulled up or transported about.

What is claimed is:

1. A hanger apparatus comprising:

(a) a pair of lateral rods each having at least one caster coupled thereto, each said lateral rod having a screw hole formed intermediately therein;

(b) a connecting bar extending between said lateral rods having a pair of distal end portions, said connecting bar including at each distal end portion a sleeve portion;

(c) a pair of side support assemblies respectively engaging said sleeve portions of said connecting bar, each said side support assembly including:

a side support tube;

a substantially U-shaped plate coupled to said support tube, said substantially U-shaped plate having a vertical bolt extending downwardly therefrom to pass through one of said sleeve portions of said connecting bar and said screw hole of one of said lateral rods for locking engagement by a fastening nut;

an inner tube telescopically coupled to said side support tube, said inner tube having at a lower portion thereof a support member formed with an upward arc-shaped recess, said inner tube having a connecting sleeve extending radially therefrom;

an inner connecting bar displaceably disposed within said inner tube, said inner connecting bar having top and bottom portions and an intermediate portion extending therebetween;

a press button coupled to said top portion of said inner connecting bar;

a stop member coupled to said intermediate portion of said inner connecting bar;

a coiled spring disposed between said press button and said stop member;

a plurality of friction wheels coupled to said bottom portion of said inner connecting bar, said friction wheels being resiliently displaceable one relative to the other between collapsed and expanded configurations; and, (d) a hang bar connected between said side support assemblies, said hanging bar having a pair of terminal portions each engaging said connecting sleeve of a respective one of said inner tubes, said hanging bar including in at least one of said terminal portions a substantially U-shaped elastic member having an inserting button protruding therefrom, said inserting button being resiliently biased to pass transversely through said terminal portion and engage said connecting sleeve of said inner tube for releasably locking said hang bar thereto;

said substantially U-shaped plate of each said side support assembly defining a gap within a respective one of said sleeve portions of said connecting bar, said friction wheels being in said expanded configuration when disposed within said gap.

2. The hanger apparatus as recited in claim 1 wherein each said sleeve portion of said connecting bar includes a bottom peripheral portion defining an arc-shaped recess for conforming engagement with a substantially cylindrical outer surface of one of said lateral rods.

3. The hanger apparatus as recited in claim 1 wherein each said sleeve portion of said connecting bar includes a ring portion extending radially therein for supporting said side support tube.

* * * * *